US012453453B2

(12) United States Patent
Wang et al.

(10) Patent No.: US 12,453,453 B2
(45) Date of Patent: Oct. 28, 2025

(54) CONTROL METHOD FOR LAYERED WASHING IN DISHWASHER AND DISHWASHER

(71) Applicants: QINGDAO HAIER DISHWASHER WASHING MACHINE CO., LTD., Shandong (CN); HAIER SMART HOME CO., LTD., Shandong (CN)

(72) Inventors: Junfu Wang, Shandong (CN); Yuling Chen, Shandong (CN); Juan Liu, Shandong (CN); Jiamei Liu, Shandong (CN)

(73) Assignees: QINGDAO HAIER DISHWASHER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 296 days.

(21) Appl. No.: 18/264,503

(22) PCT Filed: Jan. 20, 2022

(86) PCT No.: PCT/CN2022/072859
§ 371 (c)(1),
(2) Date: Aug. 7, 2023

(87) PCT Pub. No.: WO2022/166597
PCT Pub. Date: Aug. 11, 2022

(65) Prior Publication Data

US 2024/0115108 A1 Apr. 11, 2024

(30) Foreign Application Priority Data

Feb. 5, 2021 (CN) ..... 202110162920.3

(51) Int. Cl.
*A47L 15/00* (2006.01)
*A47L 15/42* (2006.01)
*A47L 15/46* (2006.01)

(52) U.S. Cl.
CPC ..... *A47L 15/0031* (2013.01); *A47L 15/4221* (2013.01); *A47L 15/46* (2013.01); *A47L 2401/04* (2013.01); *A47L 2501/03* (2013.01)

(58) Field of Classification Search
None
See application file for complete search history.

(56) References Cited

FOREIGN PATENT DOCUMENTS

CN 204542006 U 8/2015
CN 109124514 A 1/2019
(Continued)

OTHER PUBLICATIONS

International Search Report (PCT/ISA/210)4 and Written Opinion (PCT/ISA/237) both with English translations mailed on Apr. 19, 2022, by the Chinese Patent Office as the International Searching Authority for International Application No. PCT/CN2022/072859.

*Primary Examiner* — Rita P Adhlakha
(74) *Attorney, Agent, or Firm* — BUCHANAN, INGERSOLL & ROONEY PC

(57) ABSTRACT

A control method for layered washing in a dishwasher and a dishwasher itself, which includes: S101: determining a rack that holds items to be washed; S102: determining a first spray water path corresponding to the rack that holds the items to be washed; S103: controlling a water divider piece to rotate to a position that opens the first spray water path, thereby connecting the first spray water path to a water supply device and closing other spray water paths; S104: performing a pre-washing step, so that the spray water path sprays towards the rack holding the items to be washed. The method first determines the rack holding the items to be
(Continued)

washed, and then determines the first spray water path of the rack, so that the first spray water path is connected to the sink, and other spray water paths are blocked from the sink.

15 Claims, 4 Drawing Sheets

(56) References Cited

FOREIGN PATENT DOCUMENTS

| | | | |
|---|---|---|---|
| CN | 109394137 | A | 3/2019 |
| CN | 110495841 | A | 11/2019 |
| CN | 111067451 | A | 4/2020 |
| WO | 2010052040 | A2 | 5/2010 |

CONTROL METHOD FOR LAYERED WASHING IN DISHWASHER AND DISHWASHER

TECHNICAL FIELD

This disclosure relates to the field of dishwashers, specifically, to a control method for layered washing in a dishwasher and a dishwasher.

BACKGROUND

Currently, most dishwashers are for 9 sets or more. Many users wash less than 9 sets of utensils at a time, sometimes only 2-3 sets, which can be accommodated in one dishwasher rack. However, the current dishwasher washing process primarily involves simultaneous water output from the upper and lower waterways to rinse the utensils, requiring more water to drive the spray arm to rotate. When many users with high-capacity dishwashers use the dishwasher for a single cycle, there aren't that many utensils. Hence, running the washing program in such cases results in long washing times and high water consumption, leading to waste of water and electricity.

In light of this, the present disclosure has been proposed.

SUMMARY

To solve the above technical problems, the objective of this disclosure is to provide a control method for layered washing in a dishwasher and a dishwasher. By determining the rack that holds the utensils, and switching the waterway system of the dishwasher, it can perform upper or lower washing individually, thus saving water, shortening washing time, and improving user experience.

To solve the above technical problems, the basic idea of the technical solution adopted by the disclosure is as follows:

The disclosure provides a control method for layered washing in a dishwasher, which includes the following steps:

S101: determining a rack for holding items to be washed;

S102: determining a first spray water path corresponding to the rack based on the determined rack;

S103: controlling a water divider piece to rotate to a position for opening the first spray water path and closing other spray water paths, such that the first spray water path is in communication with a water supply device;

S104: performing a pre-washing step, wherein the spray water path is directed to spray water towards the determined rack.

The technical solution mentioned above, where step S103 specifically includes:

S201: controlling a driving piece to rotate a rotary piece, wherein a rotation of the rotary piece synchronously rotates the water divider piece connected thereto and multiple triggers on the rotary piece; stopping the driving piece upon receiving a signal from a water path detection device triggered by a trigger corresponding to the first spray water path, such that a through hole of the water divider piece is in communication with the first spray water path and blocked from other spray water paths.

Wherein, multiple triggers correspond one-to-one to the rotation positions of multiple water dividers, and each rotation position corresponds to a waterway switching mode.

The technical solution mentioned above, where step S201 specifically includes:

during the rotation of the rotary piece, the multiple triggers sequentially pushing a first elastic contact point of the water path detection device, causing the first elastic contact point to be in contact with a second elastic contact point and send a signal to a controller;

receiving signals emitted by the water path detection device triggered by each of the multiple triggers until the signal that the trigger corresponding to the first spray water path pushing the first elastic contact point to be in contact with the second elastic contact point is received, and then stopping the driving piece;

preferably, multiple bumps are arranged at intervals on the rotary piece, forming the multiple triggers.

The technical solution mentioned above, where step S201 also includes:

determining whether the signal received is a first signal; if the signal received is the first signal, identifying that the trigger pushing the first elastic contact point is the trigger at an initial position and the water divider piece is at the initial position; if the received signal is not the first signal, taking the received first signal as the reference, determine the trigger pushing the first elastic contact point according to a sequence of the subsequently the second signal received, and then determine the rotation position of the water divider piece, wherein the sequence of the second signals received corresponds to the sequence of other triggers relative to the trigger at the initial position.

In the above technical scheme, the first signal is a high level signal, and the second signal is a low level signal;

Preferably, the trigger at the initial position is a long bump, and other triggers are short bumps.

In any of the above technical schemes, determining the rack that holds the utensils to be washed specifically includes the following steps:

determining the rack for holding items to be washed further comprising:

receiving washing instructions including rack setting options, determining the rack for holding items to be washed based on the rack setting options; or obtaining a weight or pressure of the rack and determining the rack for holding items to be washed based on the weight or pressure of the rack; or obtaining an image information captured by an image acquisition device and determining the rack for holding items to be washed based on the image information.

In any of the above technical schemes, receiving the washing instruction specifically includes:

receiving the rack setting options and washing program setting options;

generating the washing instructions based on the received rack setting options and the washing program setting options.

In any of the above technical schemes, the washing program setting options at least include the water flow intensity setting option and the main washing step duration setting option.

In any of the above technical schemes, before controlling the dishwasher to perform the pre-washing step, it also includes the step of controlling the drainage device to drain the stagnant water. This disclosure also provides a dishwasher, which includes a controller. The controller is suitable for executing the control method for layered washing in the dishwasher described in any of the above technical schemes.

In the present disclosure, the controller first determines the rack holding the utensils to be washed, then determines the first spray waterway of the rack holding the utensils to be washed, controls the water divider to rotate to the position to open the first spray waterway, so that the first spray waterway is communicated with the sink, and other spray waterways are blocked from the sink. Using the washing pump to drive the washing water into the first spray waterway, it realizes the spray of the rack holding the utensils to be washed, thereby realizing layered washing for utensils at different positions. Not only does it save water resources, but also it doesn't need to increase the heating time of the outgoing water because the amount of outgoing water is constant, thus saving washing time and reducing unnecessary energy consumption.

In detail, the layered washing of the dishwasher at least includes pre-washing step, main washing step, rinsing step, drying step, etc. Adding a pre-washing step can achieve better washing of utensils. The controller controls the water divider to rotate to the position to open the first spray waterway before executing the pre-washing step and keeps it unchanged in the subsequent steps. The specific implementation of this disclosure will be further described in detail in conjunction with the accompanying drawings.

BRIEF DESCRIPTION OF THE DRAWINGS

The accompanying drawings serve as a part of the present disclosure and are used to provide further understanding of the present disclosure, and schematic embodiments and descriptions thereof of the present disclosure are used for explaining the present disclosure, but do not form improper limitations to the present disclosure. Apparently, the accompanying drawings in the descriptions below are merely some embodiments, and other accompanying drawings may also be obtained according to these accompanying drawings by those of ordinary skill in the art without paying creative effort. In the accompanying drawings.

In the figures: 1—water divider, 11—water divider piece, 12—spray water path, 13—water path detection device, 131—terminal one, 132—terminal two, 133—terminal three, 134—terminal four, 135—connector, 136—elastic piece, 137—rotating shaft, 14—rotary piece, 15—bump, 151—long bump, 152—short bump.

It should be noted that these figures and text descriptions are not intended to limit the scope of this disclosure in any way, but instead serve to illustrate the concepts of this disclosure to those skilled in the art through reference to specific embodiments.

DETAILED DESCRIPTION

In order to make the objectives, technical solutions, and advantages of the embodiments of this disclosure clearer, the following will provide a clear, complete description of the technical solutions in the embodiments of this disclosure with reference to the figures in the embodiments of this disclosure. The following embodiments are for illustrating this disclosure but are not used to limit the scope of this disclosure.

In the description of this disclosure, it should be noted that the terms "upper", "lower", "left", "right", "vertical", "inside", "outside" and other indications of direction or position relationships are based on the direction or position relationships shown in the figures. They are merely for convenience in describing this disclosure and simplifying the description, and do not indicate or imply that the device or component referred to must have a specific orientation, be constructed and operated in a specific orientation, and therefore should not be construed as limiting this disclosure.

Figure 4:
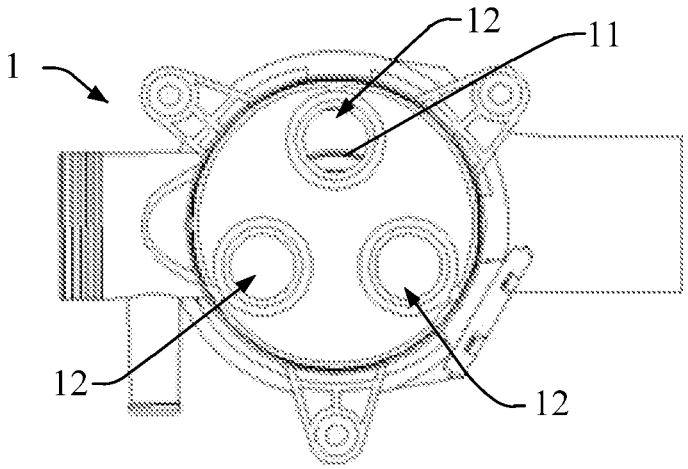
FIG. 4 is a top view of the water divider in an embodiment of this disclosure.

In the description of this disclosure, it should be noted that unless otherwise explicitly stipulated and limited, terms such as "install", "connect", "connect" should be understood in a broad sense, for example, they can be fixedly connected, or they can be detachably connected, or integrally connected; they can be mechanically connected, or electrically connected; they can be directly connected, or indirectly connected through intermediate media. For those skilled in the art, they can understand the specific meaning of the above terms in this disclosure in the specific situations. This disclosure provides a control method for layered washing in a dishwasher, wherein, as shown in FIG. 4, the dishwasher at least includes an inner tank, and at least multiple racks distributed up and down are provided in the inner tank. Each rack is correspondingly provided with a spray device. Each spray device is connected through its own spray water path 12, and multiple spray water paths 12 are connected with the water tank through the water divider 1. The water divider 1 has a rotatable water divider piece 11. The water divider piece 11 is provided with multiple through holes. When the water divider piece 11 rotates, it causes the through holes on the water divider piece 11 to be opened or blocked with the various spray water paths 12, thereby achieving the switching of the spray water path 12. It can open a single spray water path 12, or multiple spray water paths 12. The layered washing described in this disclosure refers to the act of opening the spray water path 12 corresponding to the rack when the user places the utensils on a rack, thereby achieving energy conservation and emission reduction.

Figure 1:
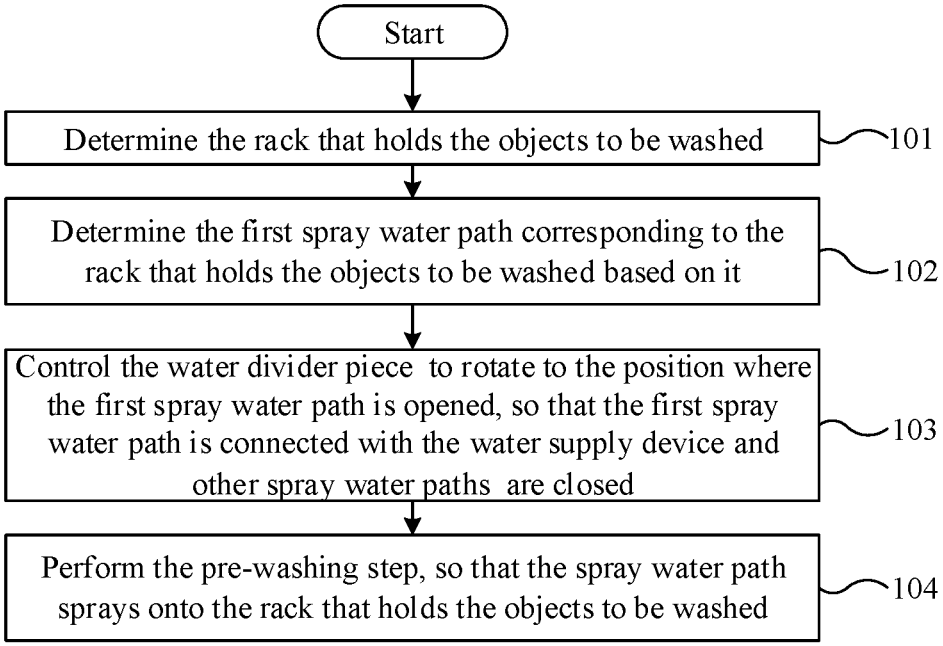
FIG. 1 is a schematic flowchart of the control method for layered washing in a dishwasher in an embodiment of this disclosure.

As shown in FIG. 1, the control method for layered washing in a dishwasher specifically includes the following steps:

- S101: Determine the rack that holds the objects to be washed;
- S102: Determine the first spray water path corresponding to the rack that holds the objects to be washed based on it;
- S103: Control the water divider piece 11 to rotate to the position where the first spray water path is opened, so that the first spray water path is connected with the water supply device and other spray water paths 12 are closed;

S104: Perform the pre-washing step, so that the spray water path 12 sprays onto the rack that holds the objects to be washed.

In this disclosure, the controller first determines the rack that holds the objects to be washed, then determines the first spray water path corresponding to the rack that holds the objects to be washed, controls the water divider piece 11 to rotate to the position where the first spray water path is opened, so that the first spray water path is connected with the water tank, and other spray water paths 12 are blocked with the water tank. The washing water is driven into the first spray water path using a washing pump, which achieves the spraying on the rack that holds the objects to be washed, thereby achieving layered washing for utensils in different positions. Not only does this save water resources, but since the water output remains constant during use, there is no need to increase the heating time for the output water, saving washing time and reducing unnecessary energy consumption.

The first spray water path can also be understood as the target spray water path.

In detail, the layered washing of the dishwasher at least includes the pre-washing step, main washing step, rinsing step, drying step, etc. Adding a pre-washing step can achieve better cleaning of the utensils. In each washing task, the controller controls the water divider piece 11 to rotate to the position where the first spray water path is opened before performing the pre-washing step, and keeps it unchanged in the subsequent steps.

Figure 5:
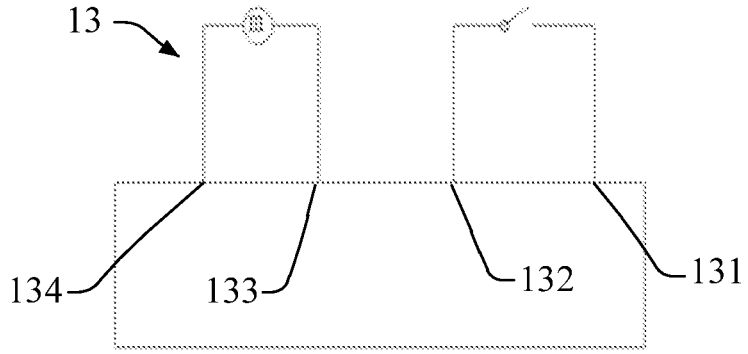
FIG. 5 is a schematic diagram of the circuit structure of the water path detection device in an embodiment of this disclosure.
Figure 6:
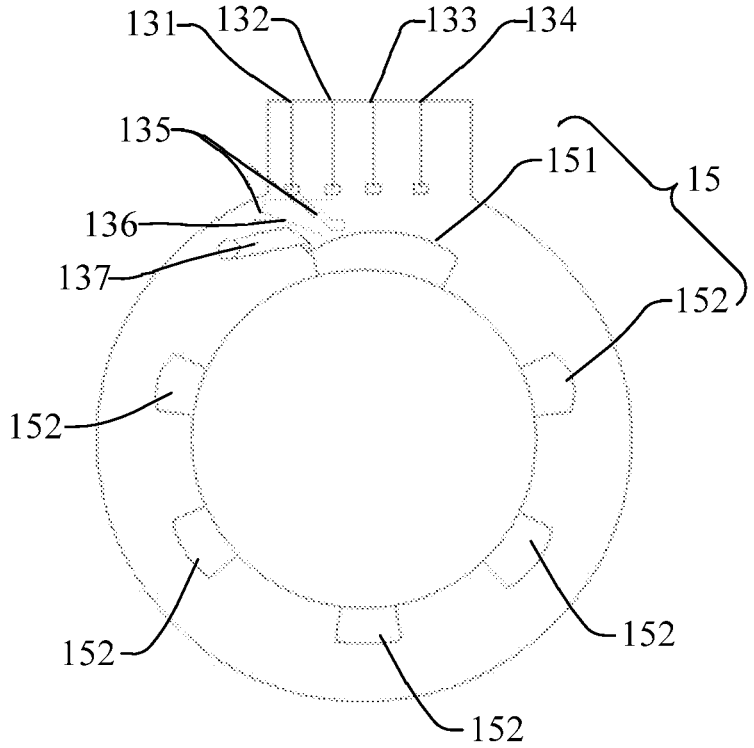
FIG. 6 is a schematic diagram of the structure of the water path detection device in an embodiment of this disclosure.

In some embodiments, as shown in FIGS. 5 and 6, a rotary piece 14 is provided to connect with the water divider piece 11, and the driving piece drives the rotary piece 14 to rotate, synchronously driving the water divider piece 11 to rotate. The rotary piece 14 is provided with multiple triggers. In detail, multiple triggers are set at intervals along the circumferential direction of the rotary piece 14, where the multiple triggers correspond one by one with the rotation positions of multiple water divider pieces 11. For example, if the dishwasher is equipped with three spray devices and three corresponding connected spray water paths 12, there are six ways to open the spray water paths 12, which are to open three spray water paths 12 separately, or to open two spray water paths 12 at the same time. Correspondingly, there are six triggers are provided. Each trigger corresponds to one way to open the spray water path 12, and three triggers correspond to opening three spray water paths 12 separately, the other three triggers each correspond to two ways to open the spray water path 12.

Figure 2:
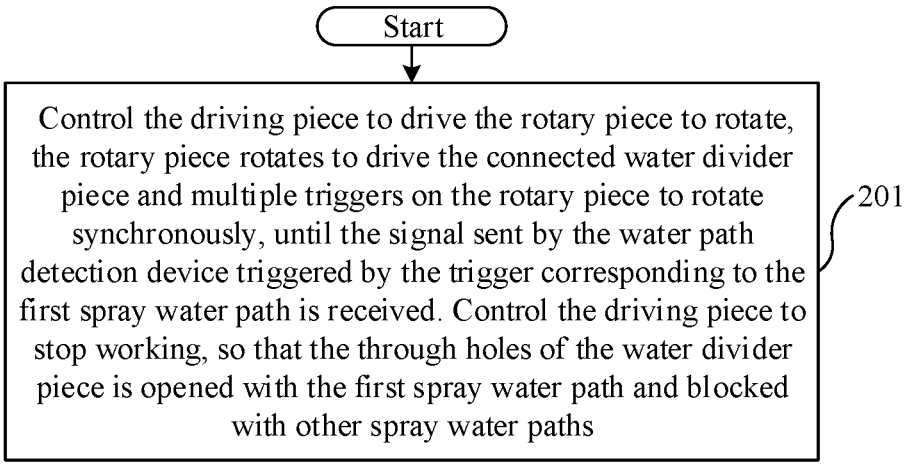
FIG. 2 is a schematic flowchart of the control method for layered washing in a dishwasher in another embodiment of this disclosure.

In this way, the current way to open the spray water path 12 can be determined based on the position of the trigger. Specifically, as shown in FIG. 2, the step S103 specifically includes:

S201: Control the driving piece to drive the rotary piece 14 to rotate, the rotary piece 14 rotates to drive the connected water divider piece 11 and multiple triggers on the rotary piece 14 to rotate synchronously, until the signal sent by the water path detection device 13 triggered by the trigger corresponding to the first spray water path is received. Control the driving piece to stop working, so that the through holes of the water divider piece 11 is opened with the first spray water path and blocked with other spray water paths 12.

Among them, multiple triggers correspond one-to-one with the rotation positions of multiple water divider pieces 11. Each rotation position corresponds to a type of waterway switching mode. In a specific implementation, each trigger can be set to emit a signal to the water path detection device 13. For example, the trigger can send an infrared signal to the water path detection device 13. The water path detection device 13 will feedback the received signal to the controller. The controller determines the current rotation position of the rotary piece 14 in real-time according to the received signal, thus determining the current rotation position of the water divider piece 11. It continues until a signal corresponding to the rotation of the water divider piece 11 to the target position is received, which instructs the driving piece to pause work. This maintains the water divider piece 11 in its current position, achieving the goal of connecting the target waterway with the water tank.

In another specific implementation, multiple triggers can also be set at intervals on the rotary piece 14. The water path detection device 13 includes a contact point connected to the controller. When the trigger rotates to the position corresponding to the contact point, the trigger can touch the contact point, causing the contact point to send a corresponding signal to the controller.

Further, the water path detection device 13 includes a first elastic contact point and a second elastic contact point communicated with the controller. The first and second elastic contact points are set at intervals.

The step S201 specifically includes:

During the rotation of the rotary piece 14, multiple triggers sequentially push the first elastic contact point of the water path detection device 13, causing the first elastic contact point to contact the second elastic contact point of the water path detection device 13 and send a corresponding signal to the controller. Receive the signal emitted by each trigger triggering the water path detection device until a signal is received in which the trigger corresponding to the first spray water path pushes the first and second elastic contact points to touch and send out a corresponding signal. This causes the driving piece to pause work.

Figure 7:
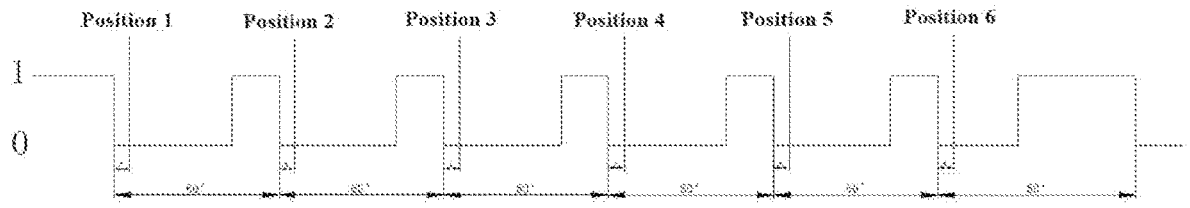
FIG. 7 is a schematic diagram of the feedback signals corresponding to the terminals at different positions in FIG. 6.

Furthermore, as shown in FIGS. 6 and 7, in this embodiment, the water path detection device 13 also includes a connector 135, an elastic piece 136, a rotating shaft 137, and a terminal. The connector 135 includes a conductive connecting rod one and connecting rod two. The terminal includes terminal one 131 and terminal two 132. One end of the connecting rod one is connected to terminal one 131 and the other end is connected to the elastic piece 136. The other end of the elastic piece 136 is a free end. The connecting rod two is connected to the terminal two 132. The rotating shaft 137 is set vertically and both the rotating shaft 137 and elastic piece 136 have elastic recovery. In this, the other end of the elastic piece 136 forms the first elastic contact point, and the connecting rod two forms the second elastic contact point. The rotary piece 14 drives the bump 15 to rotate and push the rotating shaft 137 to deform towards the elastic piece 136. The rotating shaft 137 contacts the elastic piece 136 and pushes the elastic piece 136 to connect with the connecting rod two. The terminal one 131 and terminal two 132 are connected through the elastic piece 136. When the rotary piece 14 continues to rotate with the bump 15, the bump 15 that presses the rotating shaft 137 gradually separates from the rotating shaft 137. The rotating shaft 137 uses its own elasticity to return to its initial state, while the elastic piece 136 also returns to its initial state without the pressure of the rotating shaft 137. The rotary piece 14 is disc-shaped. Terminal one 131, terminal two 132, terminal three 133, and terminal four 134 are arranged in order along the direction of rotation of the rotary piece 14. The connection between terminal one 131 and terminal two 132 forms a high potential. The controller receives the connection signal to control the corresponding waterway to open, thus completing the waterway selection. Once the waterway is selected, the driving motor stops rotating, and the rotary piece 14 also stops accordingly. The bump 15 continues to squeeze the rotating shaft 137, keeping the rotating shaft 137 pressing the elastic piece 136 to maintain the connection between terminal one 131 and terminal two 132 until the dishwasher is finished cleaning. The waterway can be selected through the rotation of the rotary piece 14, which is very convenient.

Specifically, the terminal also include terminal three 133 and terminal four 134. The connection between terminal three 133 and terminal four 134 is always open and is the output port of the driving motor.

In some implementations, one of the multiple triggers triggers the water path detection device 13 to emit a first signal, while other triggers trigger the water path detection device 13 to emit a second signal. The step S201 also includes:

Determine whether the received signal is the first signal; if yes, then it is judged that the trigger currently pushing the first elastic contact point is the trigger at the initial position, and the current water divider piece 11 is at the initial position;

if no, the received first signal is taken as a reference, and the order of the received second signal determines the current trigger pushing the first elastic contact point, thereby determining the current rotational position of the water divider piece 11, wherein the order of the received second signal corresponds to the order of the other triggers relative to the trigger at the initial position. Specifically, the trigger is set as a bump 15. Multiple bumps 15 include one long bump 151 and multiple short bumps 152 of the same length. The outer edge of the bump 15 has a radius. The outer edge of the bump 15 is set as an arc. This ensures that with the rotation of the rotary piece 14, the bump 15 can squeeze the rotating shaft 137 with a larger area. Even in the case of many waterway combination modes requiring many bumps 15, a gap can be set between each bump 15 to ensure the accuracy of waterway selection. The multiple bumps 15 are set at equal distances. The difference between the long bump 151 and the short bump 152 is only in length. When the long bump 151 rotates to the position of terminal one 131 and terminal two 132, because the length of the long bump 151 is long, the connection time between terminal one 131 and terminal two 132 is the longest. Through the connection time between terminal one 131 and terminal two 132, it is determined that the long bump 151 is squeezing the rotating shaft 137. The rotating shaft 137 presses the elastic piece 136 to keep terminal one 131 and terminal two 132 connected at all times, the water path at this time is designated as the initial position. Once the initial position is determined, because the driving motor drives the rotary piece 14 to rotate at a constant speed and the position of the bump 15 is fixed, it only needs to determine the time interval between the short bump 152 making terminal one 131 and terminal two 132 connect and the long bump 151 making terminal one 131 and terminal two 132 connect. This also determines the time to switch from the initial position to the next type of waterway combination mode. Since the bumps 15 are set at equal distances, once an interval time is determined, the time to switch to the next waterway combination mode can be confirmed, and record this information to the controller. During using, after the user sets the required water path, the driving motor drives the rotary piece 14 to rotate, first finding the set initial position, which is the long bump 151 squeezing the rotating shaft 137. The rotating shaft 137 presses the elastic piece 136 to keep terminals one 131 and two 132 connected. As the rotary piece 14 rotates, when the bump 15 corresponding to the first spray waterway squeezes the rotating shaft 137 and makes terminals one 131 and two 132 connected, the driving motor stops working. Preferably, the first signal is a high-level signal, and the second signal is a low-level signal.

In some implementations, the determination of the rack holding the items to be washed specifically includes the following steps:

Receive washing instructions, which include rack setting options;

determine the rack holding the items to be washed based on the rack setting options.

This implementation allows the user to directly select the rack that needs to be washed separately when choosing the washing program, such as the "upper wash" and "lower wash" selection buttons on the touch panel of the dishwasher, making control simpler.

In other implementations, the determination of the rack holding the items to be washed specifically includes the following steps:

obtain the weight or pressure of each rack, and determine the rack holding the items to be washed based on the weight or pressure of each rack.

Alternatively, the determination of the rack holding the items to be washed can include the following steps:

obtain image information captured by the image acquisition device, and determine the rack holding the items to be washed based on the image information.

In some implementations, the receipt of the washing instructions specifically includes:

receive rack setting options and washing program setting options;

generate the washing instructions based on the received rack setting options and washing program setting options.

In this implementation, users can set the rack that needs to be washed and specific washing parameters themselves, providing a better user experience.

Furthermore, the washing program setting options at least include water flow intensity setting options, main washing step duration setting options.

In some implementations, before controlling the dishwasher to perform the pre-washing step, it also includes the step of controlling the drainage device to drain the remaining water.

By draining the remaining water in the dishwasher before each wash, it prevents the dishes from being contaminated by dirty water, ensuring washing effectiveness.

This disclosure also provides a dishwasher, which includes a controller. The controller is suitable for implementing the control method for layered washing of a dishwasher as described in any of the above implementations.

A Specific Implementation

This disclosure provides a method of layered washing for a dishwasher. The dishwasher is equipped with a water divider 1, installed at the outlet at the bottom of the dishwasher's sink. The water path is changed by switching the position of the water divider piece 11, leading the water driven by the motor rotation into different water paths, realizing the function of layered washing. The electric water divider 1 comes with a position detection, which tells the master machine its current position.

Figure 3:
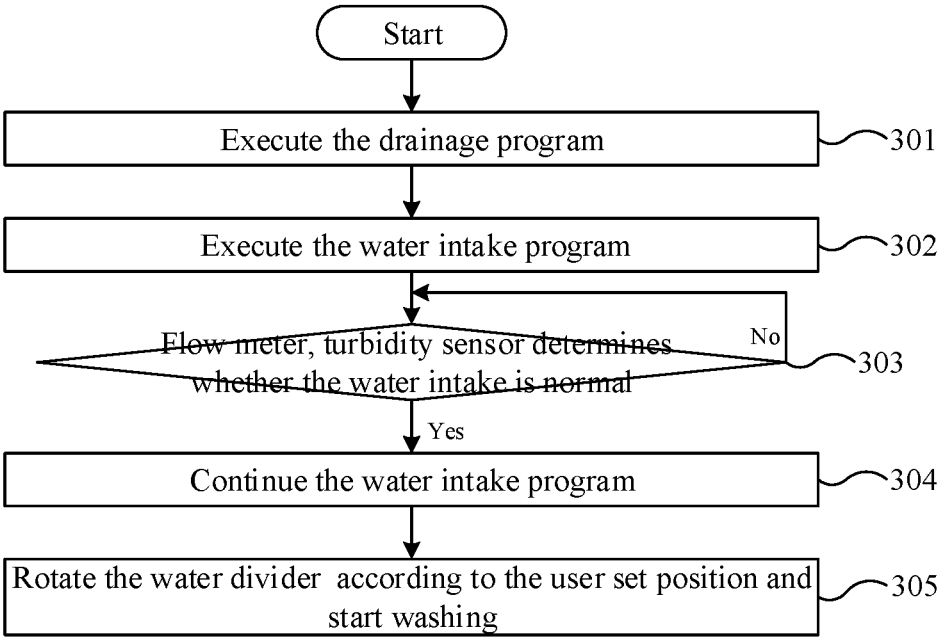
FIG. 3 is a schematic flowchart of the control method for layered washing in a dishwasher in yet another embodiment of this disclosure.

Among them, the washing process of layered washing is divided into four stages: pre-washing step, main washing step, rinsing step, drying step. The specific distribution process is as follows:

As shown in FIG. 3, the pre-washing step specifically includes the following steps:

S301: Execute the drainage program;

S302: Execute the water intake program;

S303: Flow meter, turbidity sensor determines whether the water intake is normal;

If yes, then execute step S304: Continue the water intake program;

S305: Rotate the water divider 1 according to the user set position and start washing.

The dishwasher first executes the drainage program to prevent the last water from not being drained properly, then executes the water rinse program. The water intake is judged by the flow meter and turbidity sensor. After the water intake ends, the water divider 1 is rotated according to the user's set layer position. The water is taken to work by the washing pump with the rotating spray arm, rinsing the dishes. After rinsing for a period of time, execute the drainage program, and the pre-rinsing stage ends.

Main washing step: The dishwasher can manually set the main washing time. Users can manually increase the main washing time according to the dirtiness of the dishes. The motor speed can also be changed to manually set the water flow intensity, which includes super strong, strong, standard (default), and gentle levels. After the main wash, the dishes are cleaned quite well.

Rinsing stage: After the main washing, the dishes are basically clean, need a final rinse, release the brightening agent, enhance the washing and drying effects, and the washing stage is over.

Drying stage: After the washing stage, the fan starts to work, ensuring the dryness of the dishwasher cavity, achieving a good user experience.

The above is just a better implementation of this disclosure and does not in any way limit the disclosure. Although this disclosure has been disclosed as above with better implementations, it is not intended to limit this disclosure. Any technician familiar with this patent, without departing from the technical solution of this disclosure, can make slight modifications or adjustments to the equivalent changes of equivalent implementations using the above-mentioned technical content. As long as they do not deviate from the technical content of this disclosure, according to the technical essence of this disclosure, any simple modification, equivalent change, and modification to the above implementations are still within the scope of this disclosure.

The invention claimed is:

1. A control method for layered washing in a dishwasher, comprising:

S101: determining a rack for holding items to be washed;

S102: determining a first spray water path corresponding to the rack based on the determined rack;

S103: controlling a water divider piece to rotate to a position for opening the first spray water path and closing other spray water paths, such that the first spray water path is in communication with a water supply device;

S104: performing a pre-washing step, wherein the spray water path is directed to spray water towards the determined rack, wherein step S103 includes S201: controlling a driving piece to rotate a rotary piece, wherein a rotation of the rotary piece synchronously rotates the water divider piece connected thereto and multiple triggers on the rotary piece; stopping the driving piece upon receiving a signal from a water path detection device triggered by a trigger corresponding to the first spray water path, such that a through hole of the water divider piece is in communication with the first spray water path and blocked from other spray water paths, wherein step S201 further includes: 1) during the rotation of the rotary piece, the multiple triggers sequentially pushing a first elastic contact point of the water path detection device, causing the first elastic contact point to be in contact with a second elastic contact point and send a signal to a controller; and 2) receiving signals emitted by the water path detection device triggered by each of the multiple triggers until the signal that the trigger corresponding to the first spray water path pushing the first elastic contact point to be in contact with the second elastic contact point is received, and then stopping the driving piece.

2. The control method for layered washing in the dishwasher of claim 1, step S201 further includes: determining whether the signal received is a first signal; if the signal received is the first signal, identifying that the trigger pushing the first elastic contact point is the trigger at an initial position and the water divider piece is at the initial position; if the received signal is not the first signal, taking the received first signal as the reference, determine the trigger pushing the first elastic contact point according to a sequence of the subsequently the second signal received, and then determine the rotation position of the water divider piece, wherein the sequence of the second signals received corresponds to the sequence of other triggers relative to the trigger at the initial position.

3. The control method for layered washing in the dishwasher of claim 1, wherein multiple bumps are arranged at intervals on the rotary piece, forming the multiple triggers.

4. The control method for layered washing in the dishwasher of claim 1, further comprising controlling a drainage device to drain stagnant water prior to performing the pre-washing step.

5. The control method for layered washing in the dishwasher of claim 2, wherein the first signal is a high-level signal and the second signal is a low-level signal.

6. The control method for layered washing in the dishwasher of claim 2, determining the rack for holding items to be washed further comprising:

receiving washing instructions including rack setting options, determining the rack for holding items to be washed based on the rack setting options; or obtaining a weight or pressure of the rack and determining the rack for holding items to be washed based on the weight or pressure of the rack; or obtaining an image information captured by an image acquisition device and determining the rack for holding items to be washed based on the image information.

7. The control method for layered washing in the dishwasher of claim 2, further comprising controlling a drainage device to drain stagnant water prior to performing the pre-washing step.

8. The control method for layered washing in the dishwasher of claim 5, wherein the trigger at the initial position is a long bump and other triggers are short bumps.

9. The control method for layered washing in the dishwasher of claim 5, determining the rack for holding items to be washed further comprising:

receiving washing instructions including rack setting options, determining the rack for holding items to be washed based on the rack setting options; or obtaining a weight or pressure of the rack and determining the rack for holding items to be washed based on the weight or pressure of the rack; or obtaining an image information captured by an image acquisition device and determining the rack for holding items to be washed based on the image information.

10. The control method for layered washing in the dishwasher of claim 5, further comprising controlling a drainage device to drain stagnant water prior to performing the pre-washing step.

11. The control method for layered washing in the dishwasher of claim 1, determining the rack for holding items to be washed further comprising:

receiving washing instructions including rack setting options, determining the rack for holding items to be washed based on the rack setting options; or obtaining a weight or pressure of the rack and determining the rack for holding items to be washed based on the weight or pressure of the rack; or obtaining an image information captured by an image acquisition device and determining the rack for holding items to be washed based on the image information.

12. The control method for layered washing in the dishwasher of claim 11, receiving washing instructions further comprising:

receiving the rack setting options and washing program setting options;

generating the washing instructions based on the received rack setting options and the washing program setting options.

13. The control method for layered washing in the dishwasher of claim 12, wherein the washing program setting options include at least a water flow intensity setting option and a main washing step duration setting option.

14. The control method for layered washing in the dishwasher of claim 1, further comprising controlling a drainage device to drain stagnant water prior to performing the pre-washing step.

15. A dishwasher comprising a controller configured to execute the control method of claim 1.

* * * * *